US009418810B2

(12) United States Patent
Prestini et al.

(10) Patent No.: US 9,418,810 B2
(45) Date of Patent: Aug. 16, 2016

(54) MULTIPHASE MEDIUM VOLTAGE VACUUM CONTACTOR

(71) Applicant: ABB Technology AG, Zurich (CH)

(72) Inventors: Osvaldo Prestini, Nembro (IT); Roberto Usai, Treviolo (IT)

(73) Assignee: ABB Technology AG, Zurich (CH)

( * ) Notice: Subject to any disclaimer, the term of this patent is extended or adjusted under 35 U.S.C. 154(b) by 114 days.

(21) Appl. No.: 14/275,127

(22) PCT Filed: Nov. 6, 2012

(86) PCT No.: PCT/EP2012/071924

§ 371 (c)(1),
(2) Date: May 12, 2014

(87) PCT Pub. No.: WO2013/079284

PCT Pub. Date: Jun. 6, 2013

(65) Prior Publication Data

US 2015/0303013 A1 Oct. 22, 2015

(30) Foreign Application Priority Data

Nov. 29, 2011 (EP) ..... 11191052

(51) Int. Cl.
*H01H 47/22* (2006.01)
*H01H 50/00* (2006.01)
(Continued)

(52) U.S. Cl.
CPC ..... *H01H 47/223* (2013.01); *H01H 50/002* (2013.01); *H01H 85/0241* (2013.01); *H01H 33/66* (2013.01); *H01H 85/046* (2013.01); *H01H 2085/0291* (2013.01)

(58) Field of Classification Search
CPC ..... H01H 47/223; H01H 50/022
USPC ..... 361/209
See application file for complete search history.

(56) References Cited

U.S. PATENT DOCUMENTS 3,770,917 A * 11/1973 Tjebben ..... H02B 1/36 200/50.22
2002/0097134 A1* 7/2002 Martin ..... H01H 85/046 337/297

(Continued)

FOREIGN PATENT DOCUMENTS

WO WO 01/91151 A1 11/2001

OTHER PUBLICATIONS

International Search Report (PCT/ISA/210) mailed on Feb. 15, 2013, by the European Patent Office as the International Searching Authority for International Application No. PCT/EP2012/071924.

(Continued)

*Primary Examiner* — Thienvu Tran
*Assistant Examiner* — Kevin J Comber
(74) *Attorney, Agent, or Firm* — Taft Stettinius & Hollister LLP

(57) ABSTRACT

A multiphase medium voltage vacuum contactor is disclosed which can include a mounting frame on which there are positioned: for each phase, a current interrupter having a vacuum bulb which contains a fixed contact and a corresponding movable contact; and an actuator for moving the movable contacts between a closed position where they are coupled each to a corresponding fixed contact and an open position where they are each electrically separated from the corresponding fixed contact, and an electronic unit driving the actuator. An exemplary voltage transformer for feeding the electronic unit can be mounted on the frame. One or more sacrificial fault-protection devices and/or current sensors can be operatively associated to the voltage transformer and embedded into an electrically insulating coating encasing the transformer.

17 Claims, 9 Drawing Sheets

(51) Int. Cl.

| | |
|---|---|
| ***H01H 85/02*** | (2006.01) |
| *H01H 33/66* | (2006.01) |
| *H01H 85/046* | (2006.01) |

(56) References Cited

U.S. PATENT DOCUMENTS

2005/0135030 A1 * 6/2005 Jonas ..... H01H 33/027
361/71

2008/0067152 A1 3/2008 Kikukawa et al.

OTHER PUBLICATIONS

Written Opinion (PCT/ISA/237) mailed on Feb. 15, 2013, by the European Patent Office as the International Searching Authority for International Application No. PCT/EP2012/071924.

* cited by examiner

MULTIPHASE MEDIUM VOLTAGE VACUUM CONTACTOR

RELATED APPLICATIONS

This application claims priority as a continuation application under 35 U.S.C. §120 to PCT/EP2012/071924 which was filed as an International Application on Nov. 6, 2012 designating the U.S., and which claims priority to European Application 11191052.7 filed in Europe on Nov. 29, 2011. The entire contents of these applications are hereby incorporated by reference in their entireties.

FIELD

The present disclosure relates to a multiphase medium voltage (MV) vacuum contactor which is suitable to be connected to an associated multiphase electric circuit.

For the purpose of the present disclosure, the term medium voltage refers to applications with nominal operating voltages ranging between about 1 kV and some tens of kV, for example, 3.6 kV, 7.2 kV, 12 kV, or greater.

Electric contactors have controlled users/loads involving a high number of hourly operations, for example to switch on/off electric motors, and are directed to satisfying a number of conditions which can be important to guarantee proper functional performances during their service life in electrical networks; for example, switching off maneuvers should be carried out in due time, often as quickly as possible, in order to prevent possible damage to the equipment; the actuating mechanism should be designed so as to ensure an adequate operational repeatability and an optimized reliability, and so on.

Examples of known and widely used medium voltage contactors are vacuum contactors; for each phase, they include (e.g., consist essentially of) an interrupter assembly having a sealed evacuated enclosure or chamber surrounding a fixed contact and a movable contact.

The movable contacts of the various phases are actuated by an actuator, e.g. an electromagnetic actuator, which is controlled by an associated main control/driving circuit or unit.

The contactor can also have some auxiliary circuits, accessories et cetera.

All components, e.g. vacuum interrupters, actuators, the main control/driving circuit unit, and auxiliary circuits are mounted on a contactor frame.

Current-limiting fuses can be associated to the vacuum interrupters of the contactor in order to deal with fault conditions, e.g. short circuit-currents; current-limiting fuses can be of a disposable type and include a cartridge inside which there is a heat-melting conductor.

Today, there are many different constructive solutions of medium voltage contactors which, despite allowing adequate execution of desired performances, still present some aspects which could be further improved.

For example, the energy for operating the auxiliary and/or main control circuits of the contactor is fed by components separate and distinct from the whole body of the contactor itself; the same applies for the components used to monitor the correct flow of currents.

Some additional protection devices may be also desired; e.g. additional disposable fuses of the type previously mentioned, can be used to specifically protect the elements used to supply the auxiliary and/or main control circuits.

Clearly, such aspects are not entirely satisfying since they can entail specific cabling and space occupation which in some cases can create practical difficulties, for example, when considering that contactors are often installed in switchgear panels wherein available spaces can be limited and maybe also difficult to access.

SUMMARY

A multiphase medium voltage vacuum contactor is disclosed for connection to an associated multiphase electrical circuit, comprising: a mounting frame on which there are positioned: for each phase, a current interrupter for operative connection to a corresponding phase of a multiphase electrical circuit, said current interrupter having a vacuum bulb which contains a fixed contact and a corresponding movable contact; an actuator for moving the movable contacts between a closed position where the movable contacts are coupled each to a corresponding fixed contact and an open position where the movable contacts are each electrically separated from the corresponding fixed contact; an electronic unit driving the actuator; a voltage transformer for feeding said electronic unit, the voltage transformer being mounted on said frame and at least partially encased by an electrically insulating coating; and one or more sacrificial fault-protection devices which are operatively associated to said voltage transformer and are embedded into said electrically insulating coating.

BRIEF DESCRIPTION OF THE DRAWINGS

Further characteristics and advantages will become apparent from the description of exemplary preferred but not exclusive embodiments of a multi-phase medium voltage vacuum contactor according to the disclosure, illustrated by way of non-limitative examples in the accompanying drawings, wherein.

Figure 1:
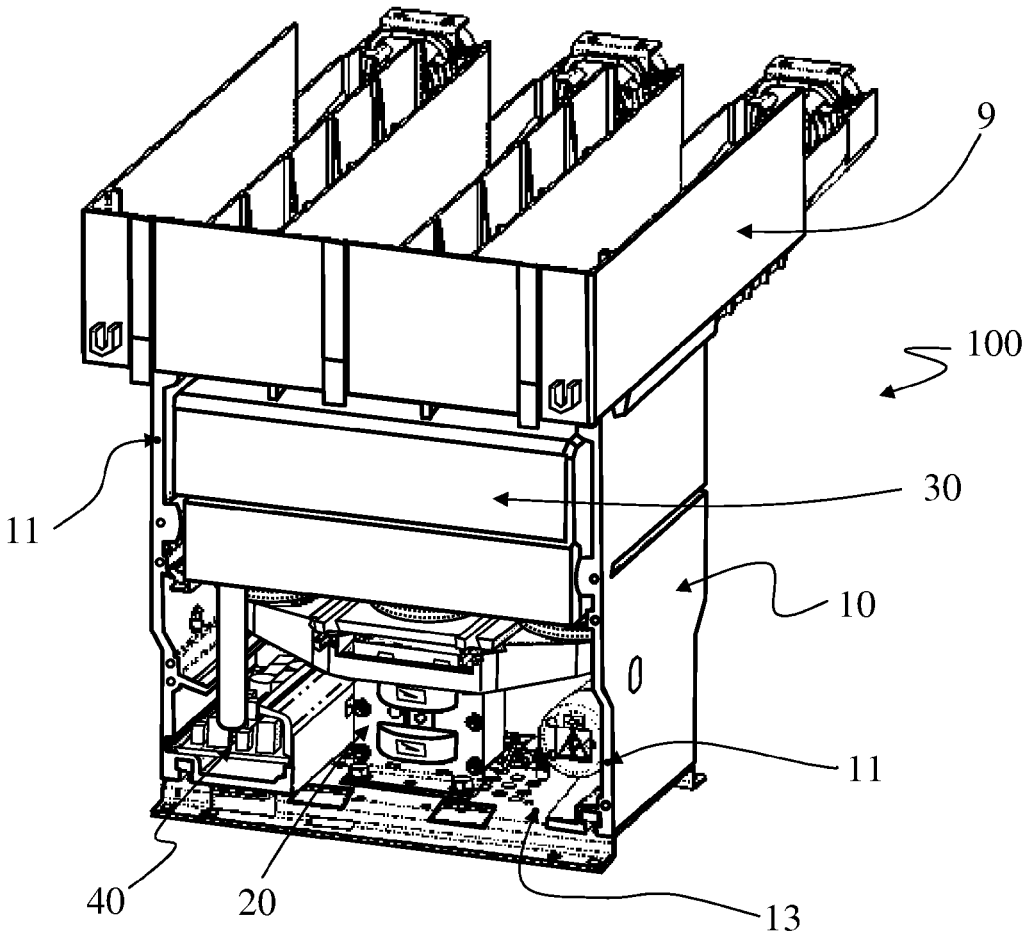
FIG. 1 is a perspective view showing an exemplary multiphase medium voltage vacuum contactor according to the present disclosure, seen from the front.

It should be noted that in the detailed description that follows, identical or similar components, either from a structural and/or functional point of view, have the same reference numerals, regardless of whether they are shown in different embodiments of the present disclosure; it should also be noted that in order to clearly and concisely describe the present disclosure, the drawings may not necessarily be to scale and certain features of the disclosure may be shown in somewhat schematic form.

The present disclosure is directed to improving the constructive layout of known contactors.

Exemplary embodiments are directed to a multiphase medium voltage vacuum contactor which is suitable to be connected to an associated multiphase electrical circuit and can include:

a mounting frame on which there are positioned:

for each phase, a current interrupter suitable to be operatively connected to a corresponding phase of the multiphase electrical circuit, the current interrupter including a vacuum bulb which contains a fixed contact and a corresponding movable contact;

an actuator for moving the movable contacts between a closed position where the movable contacts are coupled each to a corresponding fixed contact and an open position where the movable contacts are each electrically separated from the corresponding fixed contact;

an electronic unit driving the actuator;

a voltage transformer for feeding the electronic unit, the voltage transformer being mounted on the frame and at least partially encased by an electrically insulating coating; and one or more sacrificial fault-protection devices which are operatively associated to the voltage transformer and are embedded into the electrically insulating coating.

An exemplary multiphase medium vacuum contactor according to the present disclosure will be described by making reference to an exemplary three-phase medium voltage vacuum contactor; clearly, the following description can be applied to a multiphase medium vacuum contactor having any suitable number of poles or phases.

FIGS. 1-4 show an exemplary three-pole (or three-phase) medium voltage vacuum contactor generally indicated by the reference numeral 100, hereinafter referred to as the "contactor 100" for the sake of simplicity.

Figure 8:
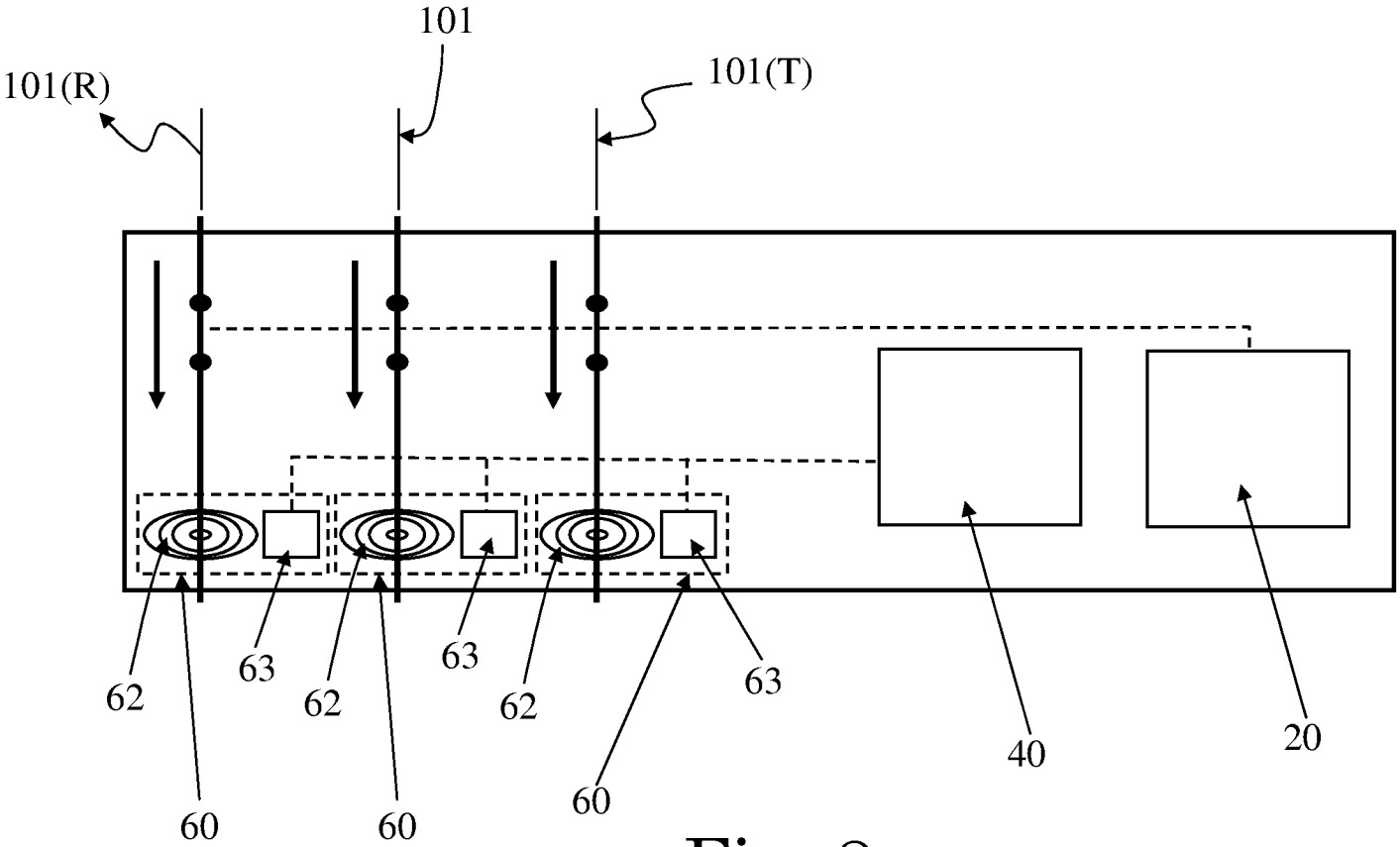
FIG. 8 is a schematic view illustrating a block diagram of exemplary components used in a multiphase medium voltage vacuum contactor according to the present disclosure.

According to well-known solutions, each of the phases or poles of the contactor 100 is suitable to be connected to an associated phase of an electrical circuit in which the contactor is used, which circuit phases are all schematically illustrated in FIG. 8 with the reference number 101.

The contactor 100 can include a mounting frame 10 which can be formed by one single mono-bloc or by two or more pieces connected together.

For instance, in the exemplary embodiment illustrated in FIGS. 1-4, the frame 10 includes a first mono-bloc, realized for example with electrically insulating material, which has a couple of side walls 11, and an intermediate region having intermediate walls 12 parallel to the side walls 11; the mono-bloc is mechanically connected to a base wall 13 which, in the exemplary embodiment illustrated, is for instance made of metallic material.

The contactor 100 can include, for each phase, a current interrupter which is mounted on the frame 10, e.g. between a side wall 11 and the adjacent intermediate wall 12, or between two adjacent intermediate walls 12, and is suitable to be operatively connected to a corresponding phase 101 of the associated multiphase electrical circuit.

Figure 2:
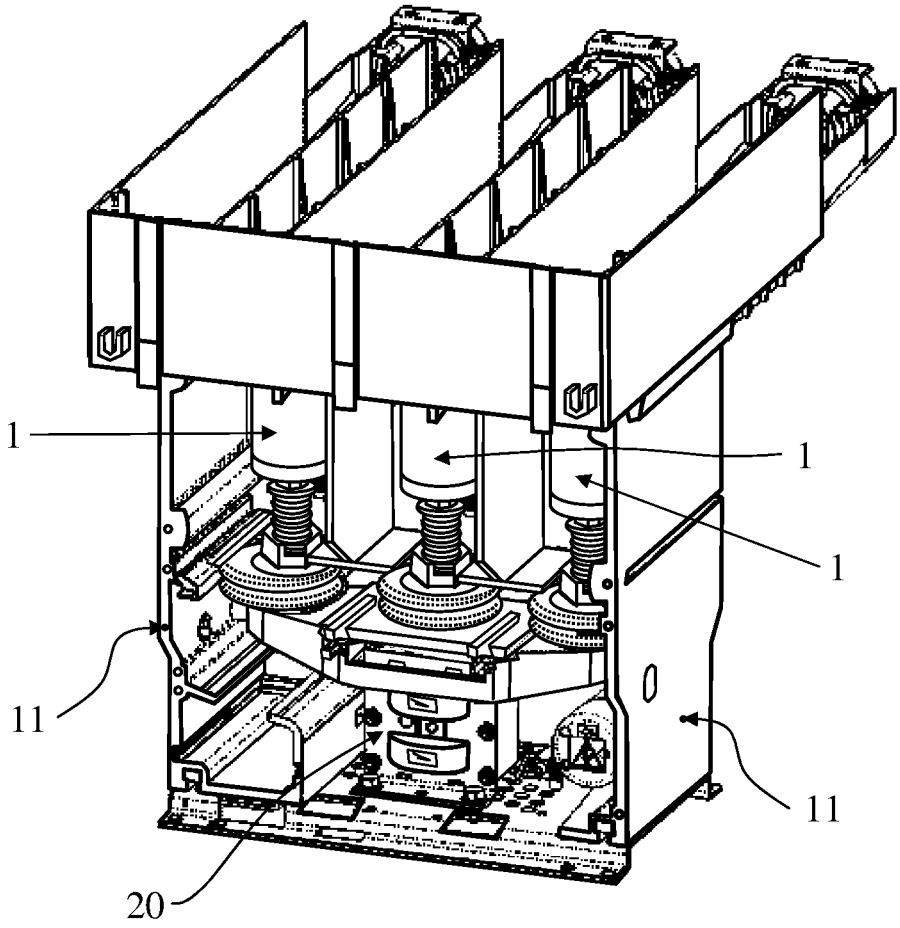
Figure 3:
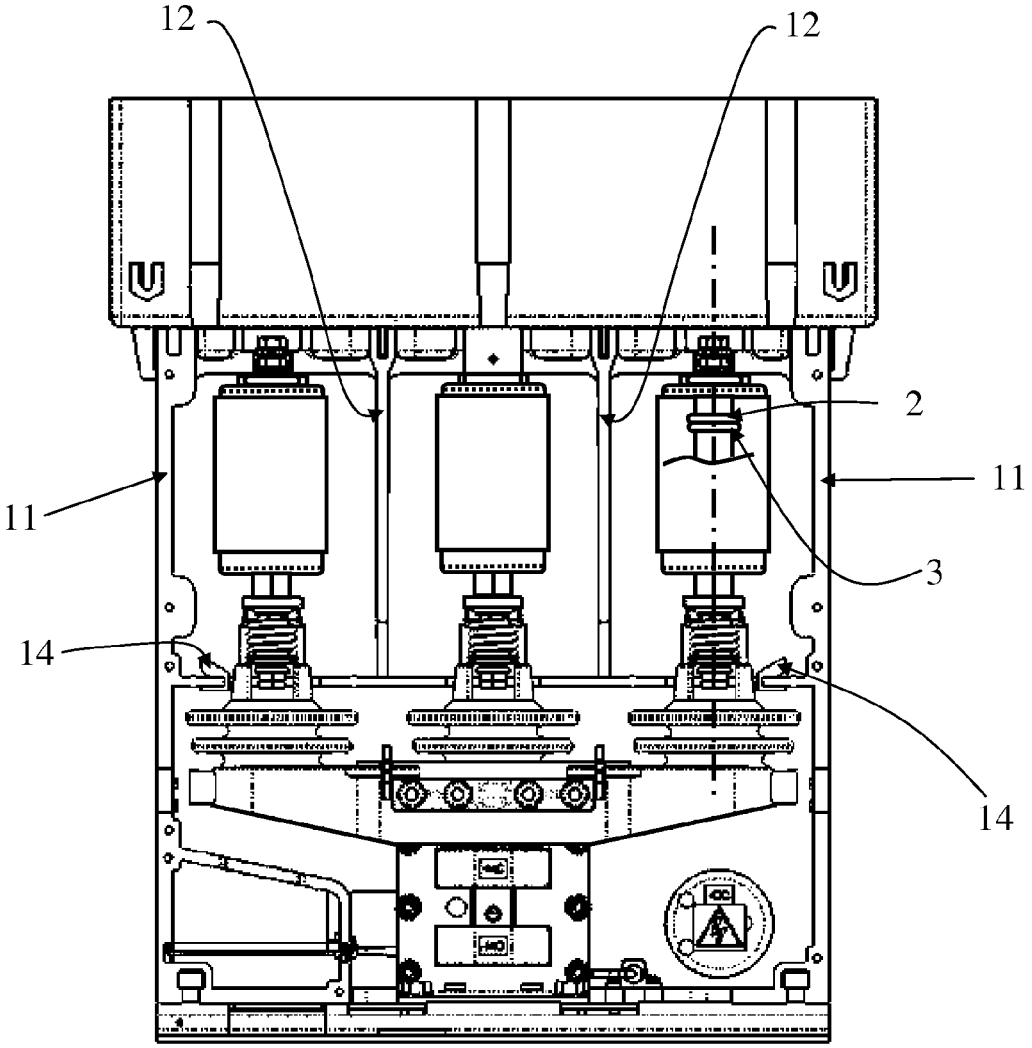
FIG. 3 is a plan view of FIG. 2.

As better visible in FIGS. 2 and 3, each current interrupter includes a vacuum bulb or bottle 1 which contains a fixed contact 2 and a corresponding movable contact 3 (illustrated for simplicity only for one pole in FIG. 3); possible constructional embodiments of the bulb 1 and ways in which the vacuum is maintained inside it are widely known in the art and therefore are not described in details herein.

At the top part of the frame 10, and according to well-known solutions, there is placed a fuse holder 9 for housing current-limiting fuses for example of traditional types, e.g. with cartridges containing each a corresponding heat-melting conductor.

On the frame 10 there is mounted an actuator 20 which is for instance connected to the base wall 13 and is suitable to move the movable contact 3 of each phase of the contactor 100 between a closed position where the movable contacts 3 are coupled each to a corresponding fixed contact 2, and an open position where the movable contacts 3 are each electrically separated from the corresponding fixed contact 2, according to solutions well known in the art or readily available to those skilled in the art.

As a person skilled in the art would appreciate, any suitable type of actuator can be used; for instance, the actuator 20 can be an electromagnetic actuator, e.g. a permanent-magnet actuator marketed by the ABB® group under the name of MAC.

Figure 1A:
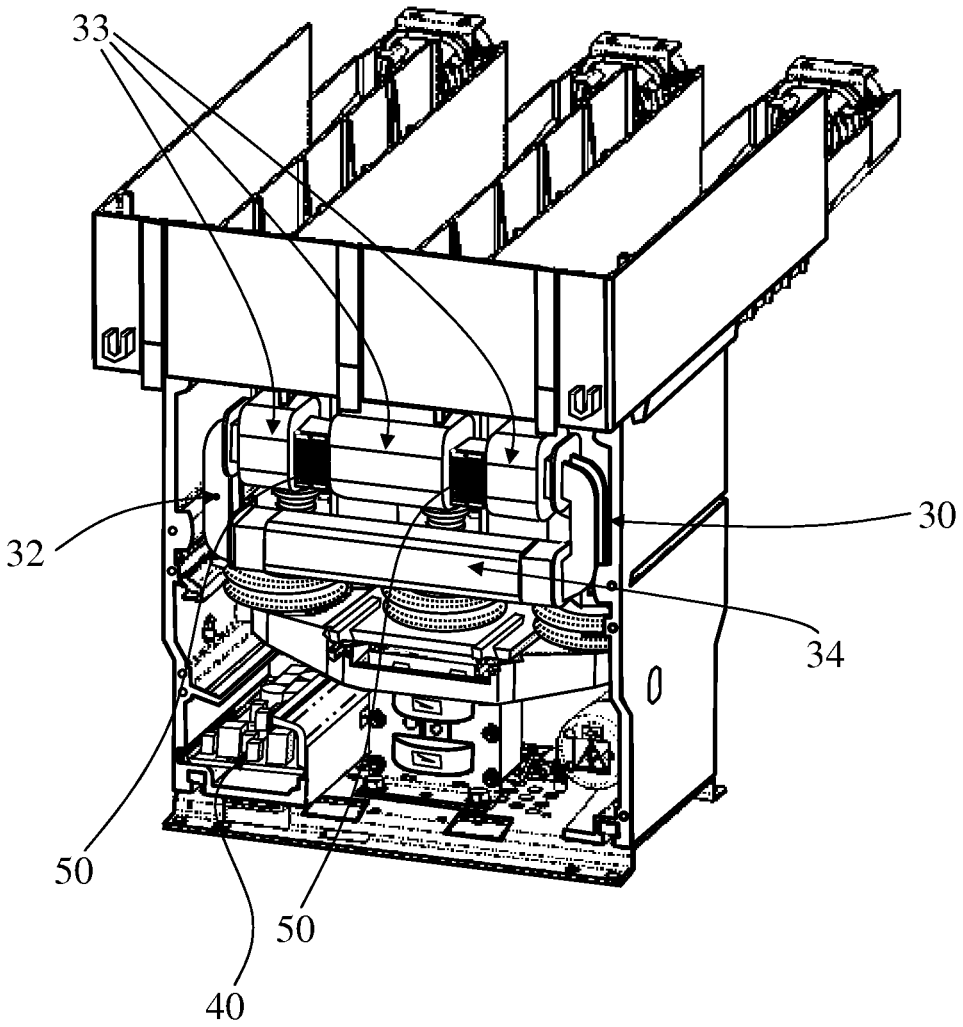
FIGS. 1*a* and 2 are perspective views showing the multiphase medium voltage vacuum contactor of FIG. 1, with some components omitted for the sake of better illustration.

An electronic unit, which is also positioned on the frame 10 and is schematically represented in FIGS. 1 and 1*a* by the reference number 40, controls and drives the operation of the actuator 20 according to solutions well known in the art and therefore not described in detail herein. Also the electronic unit 40 can be constituted by any suitable electronic unit available on the market; for example the electronic unit 40 can be constituted by an electronic device type MAC R2 marketed by the ABB® group.

The contactor 100 includes a voltage transformer 30 for feeding the electronic unit 40; as illustrated, the voltage transformer 30 is positioned directly on board on the contactor 100, namely mounted on the frame 10, and is least partially, for example, completely, encased by an electrically insulating coating 31, made for example of resin such as any suitable epoxy or polyurethane resin already available on the market.

Figure 6:
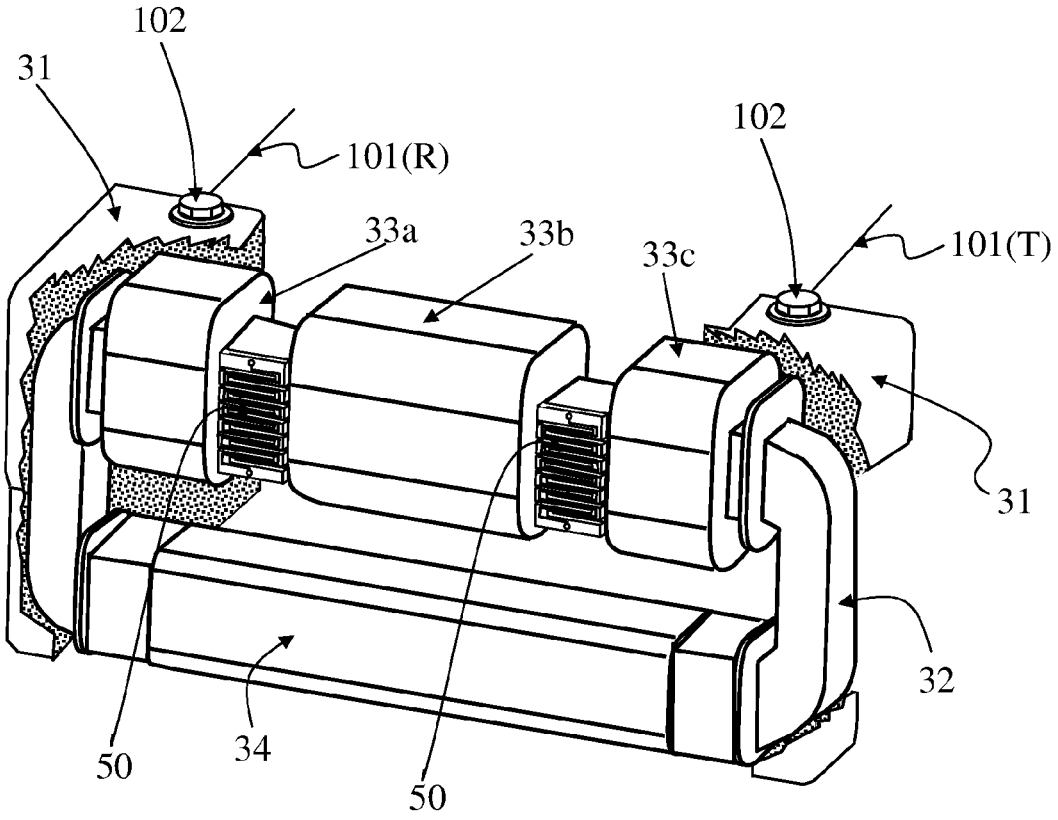
FIG. 6 is a perspective view illustrating in detail two exemplary sacrificial fault protection devices associated with a voltage transformer in a multiphase medium voltage vacuum contactor according to the present disclosure.
Figure 7:
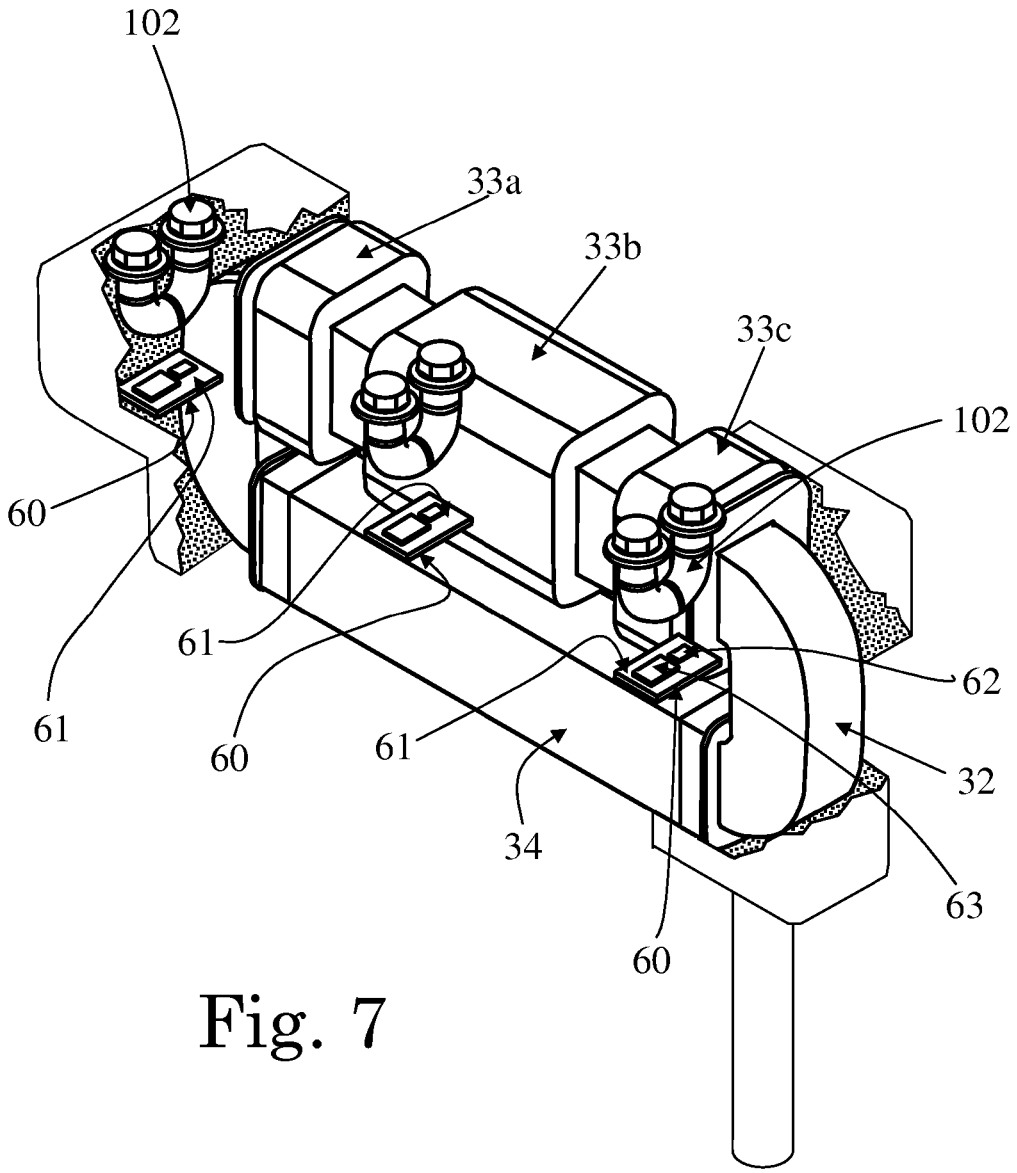
FIG. 7 is a perspective view illustrating three exemplary current monitoring devices associated with a voltage transformer in a multiphase medium voltage vacuum contactor according to the present disclosure.

For the sake of better illustrating some internal parts, the insulating coating 31 is not shown in FIGS. 1*a*, 2, 3, while it is shown partially cut in FIGS. 6 and 7.

The voltage transformer 30 is adapted (e.g., configured) to be electrically connected, once installed, only to two phases of the associated electric circuit 101, e.g. a first side phase and a second side phase schematically indicated in the FIGS. 6, 7 and 8 by the reference letters "R" and "T", respectively.

Figure 4:
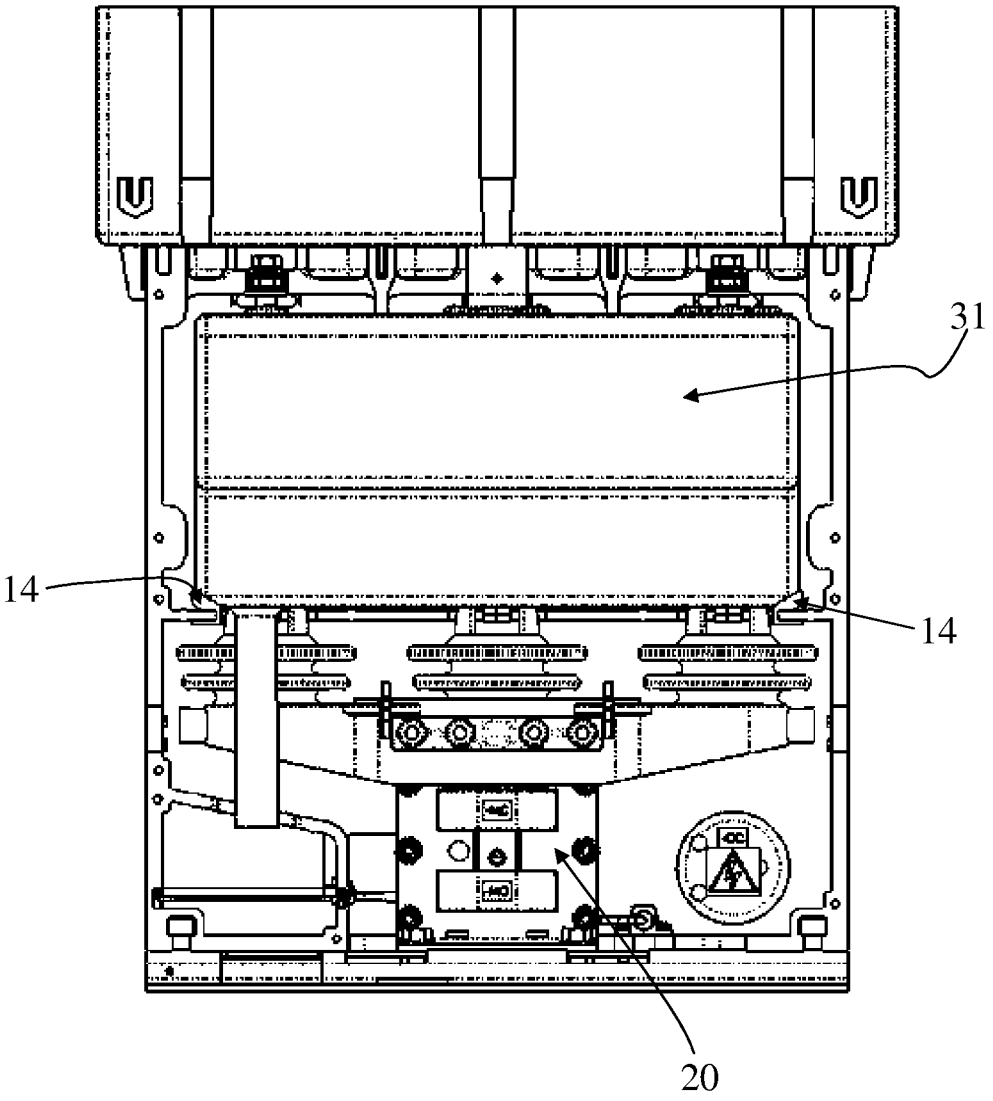
FIG. 4 is a plan view of the multiphase medium voltage vacuum contactor of FIG. 1.

In the exemplary embodiment illustrated, the voltage transformer 30 is positioned at the front, upper part of the contactor 100 close to the vacuum interrupters and between the two side walls 11 of the frame 10; as better illustrated in FIG. 4, some support dumpers 14, made for example of rubber, are positioned between and operatively connect the lower part of the voltage transformer 30 and the frame 10.

The voltage transformer 30 can include a magnetic core 32 on which there are wound a primary winding 33 which is suitable to be electrically connected to the first and second phases "R", "T" of the multiphase electrical circuit 101, and a secondary winding 34 which is suitable to feed power to the electronic unit 40 at the suitable voltage.

The primary winding 33 is for example realized in two or more sections which are wound on the magnetic core 32 spaced apart from each other and are electrically connected in series.

In the exemplary embodiments illustrated, the primary winding 33 includes at least a first lateral section 33*a*, a second central section 33*b* and a third lateral section 33*c* which are wound on the magnetic core 32 spaced apart from each other, and are electrically connected in series.

The central section 33*b* can be formed by a unique part as illustrated for example in FIGS. 6-7, or it can be split in two or more subsections.

One or more sacrificial fault-protection devices, schematically illustrated in figures by the reference number 50, are operatively associated to the voltage transformer 30 and are embedded into the electrically insulating coating 31.

Figure 5:
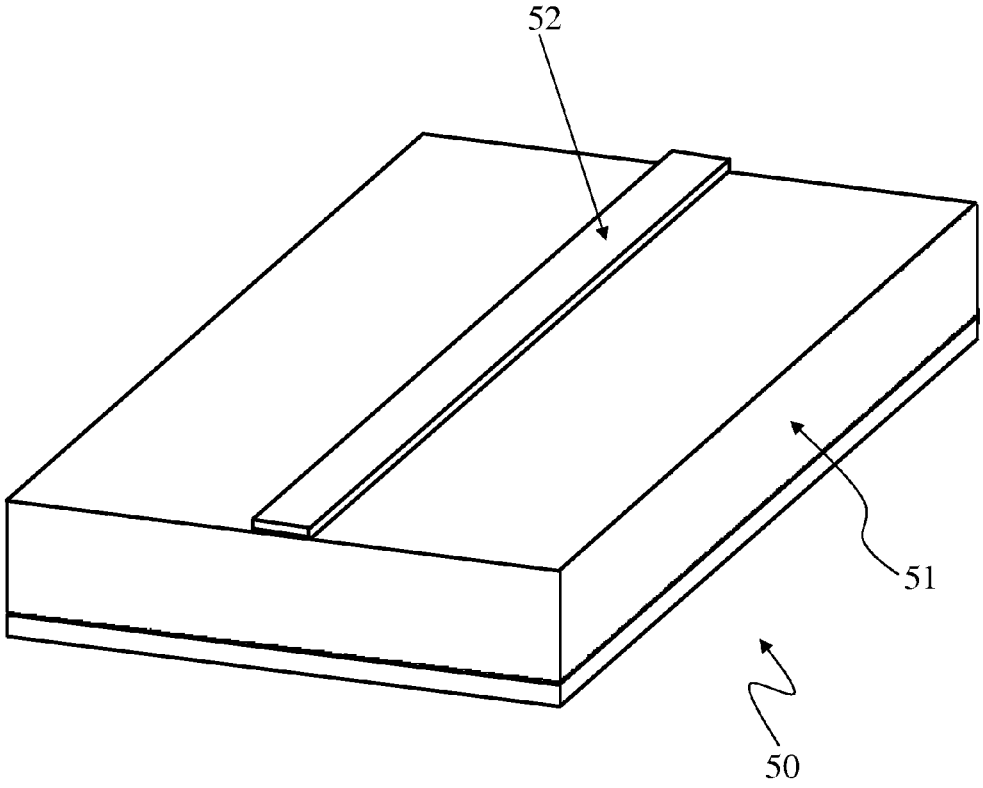
FIG. 5 is a perspective view schematically illustrating an exemplary sacrificial fault protection device usable in a multiphase medium voltage vacuum contactor according to the present disclosure.

As schematically illustrated in FIG. 5, the one or more sacrificial fault-protection devices 50 can each include an electrically insulating board or support 51 on which there is securely fixed, e.g. printed, at least one track 52 of electrically conductive material; the at least one track 52 is adapted to melt when the level of current flowing in it exceeds a predefined threshold which can be set based on the specific application.

For example, the board 51 can be made of ceramic, or fiber-glass, or plastics or any other suitable material or combination of materials; the track 52 can be made of copper, or silver, or any other suitable electrically conductive material or combination of materials.

As it will be appreciated by those skilled in the art, the track 52 can be easily sized according to the specific applications, for example using Onderdonk's or Preece's equations.

In the embodiments illustrated, the contactor 100 can include two sacrificial fault protection devices 50.

For example, a first sacrificial fault-protection device 50 and a second sacrificial fault-protection device 50 are positioned form an electrical point of view upstream and downstream the primary winding 33 of the voltage transformer 30, respectively; the first sacrificial fault-protection device 50, the primary winding 33 and the second sacrificial fault-protection device 50 are electrically connected in series one next to the other.

As illustrated in FIG. 6, the first sacrificial fault-protection device 50 is embedded into the electrically insulating coating 31 at a position between the first and second sections 33*a*, 33*b*, while the second sacrificial fault-protection device 50 is embedded into the electrically insulating coating 31 at a position between the second and third sections 33*b*, 33*c*.

The exemplary contactor 100 according to the present disclosure can further include one or more current monitoring devices 60 that are also embedded into the electrically insulating coating 31; for example, in the exemplary embodiment illustrated in FIG. 7, for each phase there is a corresponding current monitoring device 60.

Each current monitoring device 60 can include a supporting board 61 on which there are securely mounted a current sensor 62 and an associated microprocessor-based unit 63 which is operative communication with the electronic unit 40.

For example, also in this case the support board 61 can be made of ceramic, or fiber-glass, or plastics or any other suitable material or combination of materials; and the current sensor 62 and/or the microprocessor-based unit 63 can be printed on the support board 63.

For example, the current sensor 62 is a Hall-effect current sensor; in turn, the microprocessor-based unit 63 can be constituted by any suitable device available on the market, e.g. a microcontroller MSP430 marketed by Texas Instruments.

In practice when the contactor 100 is installed, the first sacrificial protection 50 is electrically connected in series between the first lateral phase "R" of the associated circuit 101 and the primary winding 33 of the voltage transformer 30, while the second sacrificial fault protection device 50 is connected in series between the primary winding 33 and the second lateral phase "T" of the circuit 101. For example, such current connections between the phases of the contactor 100 and the phases of the circuit 101 occur through the bolted terminals 102.

The current monitoring devices 60 are each associated to the corresponding phase 101 with the current sensors 62 at a certain distance from the current conducting conductors.

In exemplary normal operating conditions, the current flows through the sacrificial fault-protection devices 50 and the voltage transformer 30 which feeds the electronic unit 40 (as well as other auxiliary circuits when present) with a power at a suitable level of transformed voltage.

In turn, each microprocessor-based unit 63 receives from the respective current sensor 62 signals of the current detected and outputs to the electronic unit 40 corresponding signals indicative of the current flowing into the corresponding phase of the multiphase electrical circuit 101.

If there is a fault in the windings of the voltage transformer 30, e.g. a short circuit, the overcurrent flowing along the track 52 heats up the track 52 itself until it melts and interrupts the flow of current. In practice the protection devices, and in particular the tracks 52, are calibrated so as they start to melt down when the current flowing through them exceeds a defined threshold; such threshold represents in practice an equilibrium level at which there is a balance between heating of the track 52 due to the flow of current and cooling of the track itself through the supporting board 51 and/or the surrounding insulating coating 31.

Hence, in case of over-currents above the defined threshold, the protection devices 50 sacrifice themselves but avoid damages on the closing parts of the voltage transformer 30 and in particular that the voltage transformer may blow up after an internal fault. Indeed, without the sacrifice of the protection devices 50 the voltage transformer 30 could even explode or catch on fire thus creating very dangerous and damaging conditions for the surrounding parts. Once the protection devices have intervened, the voltage transformer 30 together with the components embedded therein can be disposed and replaced by new ones.

In turn, the electronic unit 40 can be properly adapted, e.g. with software and/or electronic circuitry, to exploit the signals supplied by the various current monitoring devices. Indeed, it is possible for instance to easily set related thresholds and perform protection interventions for fault conditions regarding for example unbalanced phases, locked rotors (when the contactor is used to protect motors), thermal memory, et cetera.

In practice it has been found that exemplary medium voltage vacuum contactors according to the disclosure can provide improvements over the known prior art.

Indeed, as described herein and differently from known contactors, the contactor 100 can be a stand-alone device where the basic elements are directly on board on it; the voltage transformer 30 together with the components embedded therein form a sub-unit which can be easily mounted on board of the contactor 100 itself and easily replaced. Thanks to the division of the primary winding into sections and to the physical positioning of the sacrificial protection devices 50 in the insulating coating and between the winding sections, the voltage distribution over the primary winding of the voltage transformer and space occupation can be optimized at the same time.

These results can be achieved with a structure which is quite simple, compact and effective; as disclosed, for example the sacrificial protection devices 50 and/or the current monitoring devices 60 can be produced very simply as printed circuit boards.

This makes the contactor easy to be used in electric switchgear panels of the type having a cabinet internally divided into one or more compartments one of which accommodates a contactor 100. Hence, the present disclosure encompasses also an electric switchgear panel having a multiphase medium voltage vacuum contactor as described herein.

The contactor 100 can be suitable for modifications and variations, all of which are within the scope of the inventive concept as defined by the appended claims and including any combination of the herein described embodiments; for example, depending on the applications, the frame 10 can be formed in a unique body, or it can include two or more pieces, or if the contactor is in the form of a withdrawable contactor, it can include a sliding truck, et cetera. The sacrificial devices 50 can be differently shaped; for instance, the track 52 can be formed by one or more layers of conductive material(s), where the material can be the same for all layers, or different materials can be used. For each sacrificial device there could be only one track or more tracks, e.g. fixed on different faces of the support board 51. Track(s) can extend along any suitable path, e.g. rectilinear as illustrated in FIG. 5, curved, segmented (as illustrated in FIG. 6), mixed et cetera.

In practice, the materials used, so long as they are compatible with the specific use, as well as the dimensions, may be any according to desired specifications and the state of the art.

It will thus be appreciated by those skilled in the art that the present invention can be embodied in other specific forms without departing from the spirit or essential characteristics thereof. The presently disclosed embodiments are therefore considered in all respects to be illustrative and not restricted. The scope of the invention is indicated by the appended claims rather than the foregoing description and all changes that come within the meaning and range and equivalence thereof are intended to be embraced therein.

The invention claimed is:

1. A multiphase medium voltage vacuum contactor for connection to an associated multiphase electrical circuit, comprising:

a mounting frame on which there are positioned:

for each phase, a current interrupter for operative connection to a corresponding phase of a multiphase electrical circuit, said current interrupter having a vacuum bulb which contains a fixed contact and a corresponding movable contact;

an actuator for moving the movable contacts between a closed position where the movable contacts are coupled each to a corresponding fixed contact and an open position where the movable contacts are each electrically separated from the corresponding fixed contact;

an electronic unit driving the actuator:

a voltage transformer for feeding said electronic unit, the voltage transformer being mounted on said frame and at least partially encased by an electrically insulating coating; and one or more sacrificial fault-protection devices which are operatively associated to said voltage transformer and are embedded into said electrically insulating coating.

2. The multiphase medium voltage vacuum contactor according to claim 1, wherein said one or more sacrificial fault-protection devices each comprise:

an electrically insulating board on which there is securely fixed at least one track of electrically conductive material, said at least one track being adapted to melt when a level of current flowing in it exceeds a predefined threshold.

3. The multiphase medium voltage vacuum contactor according to claim 2, comprises:

two sacrificial fault protection devices.

4. The multiphase medium voltage vacuum contactor according to claim 2, wherein said voltage transformer is adapted to be connected to a first phase and to a second phase of a multiphase electrical circuit.

5. The multiphase medium voltage vacuum contactor according to claim 4, wherein said voltage transformer comprises:

a magnetic core;

a primary winding which is configured to be electrically connected to said first and second phases of the multiphase electrical circuit; and a secondary winding, and wherein said two sacrificial fault-protection devices comprise:

a first sacrificial fault-protection device and a second sacrificial fault-protection device which are positioned upstream and downstream said primary winding, respectively, said first sacrificial fault-protection device, said primary winding and said second sacrificial fault-protection device being electrically connected in series.

6. The multiphase medium voltage vacuum contactor according to claim 5, wherein said primary winding comprises:

at least a first section, a second section and a third section which are wound on said magnetic core spaced apart from each other and electrically connected in series, and wherein said first sacrificial fault-protection device is embedded into said electrically insulating coating at a position between said first and second sections, and said second sacrificial fault-protection device is embedded into said electrically insulating coating at a position between said second and third sections.

7. The multiphase medium voltage vacuum contactor according to claim 1, comprising:

one or more current monitoring devices which are embedded into said electrically insulating coating.

8. The multiphase medium voltage vacuum contactor according to claim 7, wherein said one or more current monitoring devices comprise, for each phase:

a supporting board on which there are mounted a current sensor and an associated microprocessor-based device which is in operative communication with said electronic unit.

9. The multiphase medium voltage vacuum contactor according to claim 8, wherein said current sensor is a Hall-effect current sensor.

10. The multiphase medium voltage vacuum contactor according to claim 1, comprising:

a plurality of support dumpers which are positioned between and operatively connect said voltage transformer and the frame.

11. An electric switchgear panel, comprising:

a multiphase medium voltage vacuum contactor according to claim 1.

12. The multiphase medium voltage vacuum contactor according to claim 6, comprising:

one or more current monitoring devices which are embedded into said electrically insulating coating.

13. The multiphase medium voltage vacuum contactor according to claim 12, wherein said one or more current monitoring devices comprise, for each phase:

a supporting board on which there are mounted a current sensor and an associated microprocessor-based device which is in operative communication with said electronic unit.

14. The multiphase medium voltage vacuum contactor according to claim 13, comprising:

a plurality of support dumpers which are positioned between and operatively connect said voltage transformer and the frame.

15. An electric switchgear panel, comprising:

a multiphase medium voltage vacuum contactor according to claim 14.

16. The multiphase medium voltage vacuum contactor according to claim 4, in combination with a multiphase electrical circuit comprising:

at least the first and second phases.

17. The multiphase medium voltage vacuum contactor according to claim 5, in combination with a multiphase electrical circuit comprising:

at least the first and second phases.

* * * * *